United States Patent [19]

Smith

[11] Patent Number: 4,917,239

[45] Date of Patent: Apr. 17, 1990

[54] AUTOMOTIVE ELECTRIC POWER TOOL AUTO AND KIT

[76] Inventor: Vincent K. Smith, 555 Plaza Venetiaway, Apt. 301, Miami, Fla. 33132

[21] Appl. No.: 339,402

[22] Filed: Apr. 17, 1989

[51] Int. Cl.[4] ..... B65D 69/00

[52] U.S. Cl. ..... 206/349; 206/349

[58] Field of Search ..... 206/234, 349, 240, 223, 206/576, 351, 379, 378

[56] References Cited

U.S. PATENT DOCUMENTS 3,317,076 5/1967 Enders ..... 206/349

4,478,330 10/1984 Lin ..... 206/234

4,660,610 4/1987 McIntire III ..... 206/349

4,703,852 11/1987 Verdier ..... 206/349

*Primary Examiner*—Joseph Man-Fu Moy

*Attorney, Agent, or Firm*—Malloy & Malloy

[57] ABSTRACT

An automotive electric power tool and kit for use in removing lugs from an automobile wheel of a vehicle equipped with a cigarette lighter which includes a portable container including a hingedly connected lid and stored therein a rechargeable battery means including a step-up transformer and a power tool electrically connected to the battery and wherein the kit is provided with a connector means to electrically connect the battery to the cigarette lighter of a vehicle for recharging it.

1 Claim, 1 Drawing Sheet

AUTOMOTIVE ELECTRIC POWER TOOL AUTO AND KIT

FIELD OF THE INVENTION

This invention relates to an automotive electric power tool and kit.

BACKGROUND OF THE INVENTION

Oftentimes on the road it is necessary to remove lugs from a wheel on which the tire has become flat. This is often a difficult task for certain infirm persons and women. This invention is of an automotive electric power tool and kit for use in removing the lugs by use of a tool which is powered by a rechargeable battery which in turn is recharged when not in use by the cigarette lighter of the vehicle.

OBJECTS OF THIS INVENTION

It is an object of this invention, accordingly, to provide an improved automotive electric power tool and kit for use inconveniently and easily removing lugs from a wheel on which a tire has become flat. It includes a portable container or carrying case in which there is a rechargeable battery preferably with a step-up transformer and a power tool electrically connected to the battery for use in driving a socket to remove or install a lug on a wheel and it includes means carried on the container for electrical engagement with the cigarette lighter of a vehicle.

DETAILED DESCRIPTION OF THE PREFERRED EMBODIMENT

Figure 1:
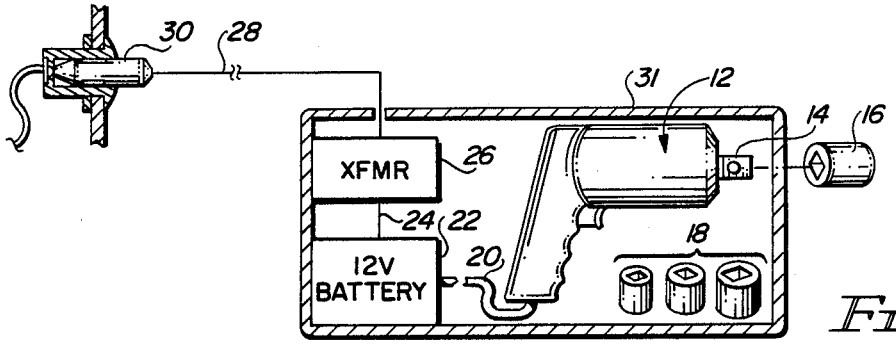
FIG. 1 is a diagramitic view of the invention.

The automotive electric power tool and kit as seen generally in FIG. 1 contains a power tool 12 with a drive shaft 14 to connect to one socket 16 of a series 18 in the container. The battery is connected through a cable 20 of about 30 to 36 inches in length to a rechargeable battery 22 in the container which is electrically connected through conductor 24 to a step-up transformer 26 which has a lead line from the container 28 and a terminal end with a fitting 30 sized for electrical engagement with the cigarette lighter of a vehicle.

In use, the rechargeable battery is charged by plugging the fitting 30 into the cigarette lighter. It is intended that the battery will be charged at all times when not in use as a tool. When use as a tool is to take place, the fitting is disconnected from the cigarette lighter and the tool box or kit is moved to a tire wheel and, after the hub cap has been removed, the power tool is utilized by selecting a correct socket to remove the lugs from a wheel. Preferably, the motor is a series wound motor producing about 50 to 70 foot pounds of torque which is light in weight, weighing about 2 to 3 pounds. The kit case or container is portable and the fitting is designed to mate with a cigarette lighter so that the battery or power supply may be recharged using a transformer to adjust the voltage to the correct level. The case will provide for universal lug sockets and have a carrying handle. Preferably, the cable connecting the tool to the battery is about at least 32 inches in length. Generally, the weight of the tool is expected to be about 7 pounds.

Figure 2:
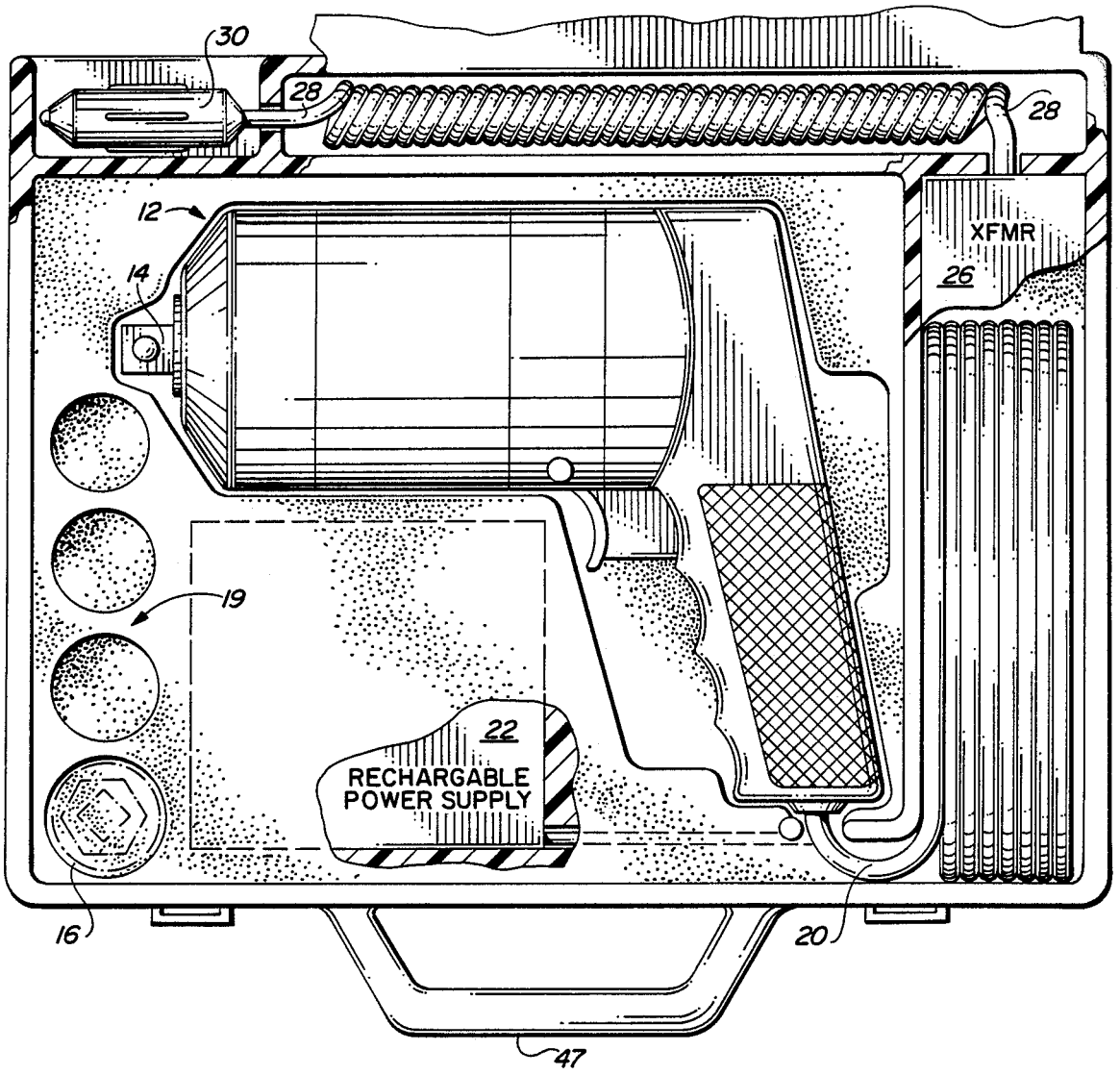
FIG. 2 is a view partially broken away showing the invention.

In a preferred embodiment shown in FIG. 2, the container represented by the numeral 31 has a hingedly connected cover, not shown, and in the container 31, the battery unit 22 is housed as is the transformer 26 while the cable 20 connecting to tool to the battery is also housed within the container. The selection of sockets are in the portion of the container designated by the numeral 19 at the left of FIG. 2. The handle for the case is designated by the numeral 47.

While the instant invention has been shown and described in what is considered to be a practical and preferred embodiment, it is recognized that departures may be made within the spirit and scope of this invention which is, therefore, not to be limited except within the doctrine of equivalents.

What is claimed is:

1. An automotive electric power tool and kit for use in removing lugs from an automobile wheel of a vehicle equipped with a cigarette lighter comprising, a portable container including a rechargeable battery means in the container, step-in transformer means electrically connected to the battery means, a reversible power tool electrically connected to the battery means and including a drive shaft, means carried in the container for electrical engagement with the cigarette lighter of the vehicle and lug socket means sized for selective mating driving connection on the drive shaft.

* * * * *